US005379365A

United States Patent [19]

Lesage

[11] Patent Number: 5,379,365

[45] Date of Patent: Jan. 3, 1995

[54] REPLACEABLE ADAPTOR FOR A HOT WATER TANK RESISTIVE HEATING ELEMENT

[75] Inventor: Claude Lesage, Pointe-Claire, Canada

[73] Assignee: Giant Factories Inc., Montreal, Canada

[21] Appl. No.: 10,856

[22] Filed: Jan. 29, 1993

[51] Int. Cl.[6] ..... F24H 1/20; H05B 3/82

[52] U.S. Cl. ..... 392/455; 392/451; 392/447

[58] Field of Search ..... 392/451, 453, 455, 457, 392/448, 447, 449, 501

[56] References Cited

U.S. PATENT DOCUMENTS

| | | | |
|---|---|---|---|
| 3,111,572 | 11/1963 | Drugmand | 392/455 |
| 3,202,795 | 8/1965 | Kreiser | 392/455 |
| 3,202,796 | 8/1965 | Drugmand | 392/455 |
| 4,506,140 | 3/1985 | Armstrong | 392/455 |
| 4,848,616 | 7/1989 | Nozaki | 392/455 |

FOREIGN PATENT DOCUMENTS

| | | | |
|---|---|---|---|
| 3902400 | 8/1990 | Germany | 392/455 |

*Primary Examiner*—Mark H. Paschall

[57] ABSTRACT

An adaptor assembly for securing a resistive electric heating element to a hot water heating tank. The adaptor assembly comprises a hollow hub sealingly securable with a hole in a hot water tank outer wall with a connecting portion of the hub extending outwardly of the outer wall. At least two opposed retention members are provided in a connecting portion of the hub to receive and removably retain an adaptor plate. The adaptor plate is connectable to a resistive heating element bracket by fasteners to secure the bracket to the plate with a resistive element of the bracket extending in the tank through the hub. The adaptor plate is secured to the hub by interference the retention members of the hub and a seal is disposed between the bracket and the hub and sealingly engaged by the pressure applied by the fasteners.

7 Claims, 4 Drawing Sheets

REPLACEABLE ADAPTOR FOR A HOT WATER TANK RESISTIVE HEATING ELEMENT

BACKGROUND OF INVENTION

1. Field of the Invention

The present invention relates to an adaptor assembly for securing a resistive electric heating element to a hot water heating tank and more particularly to a heating tank having an inner glass lining.

In particular, the present invention is concerned with an adaptor which has a hub portion which extends in a hole formed in the side wall of the tank with the hub welded thereto and wherein an adaptor plate is removably retained about a connecting portion of the hub.

2. Description of Prior Art

In the prior art, it was customary to weld the hub to the tank from the interior of the tank. This was a health hazard to the welder because he had to from inside the tank where there was no ventilation. The hub therefore had to be soldered from the outside. However, because the hubs are casted pieces and have an integral connecting flange, it provided difficult to obtain a perfect weld about the hub. After the adaptor was secured to the tank, it was then necessary to subject the tank and the adaptor to temperatures up to 1600° F. in order to adhere a glass lining to the inside of a tank. At these high temperatures, the steel loses carbon and the hub and its flange were considerably weakened. Because the flange is weaken, it often breaks when the resistive element assembly is connected to the flange by bolt fasteners. Because it is very difficult to repair such coupling, often, the tank would be discarded when the adaptor broke. Another disadvantage of using casted adaptors, is that the hub and its flange are often weaken during diecasting and forging as air bubbles form within the metal and form voids and weaken the metal of the flange. The dies for making these adaptors are also very costly. A still further disadvantage of the prior art is the hub of the adaptor is fused in a bore formed in the tank and if the bore is not perfectly round, the fused metal seal developes leaks. Accordingly, known adaptors for connecting resistive heating elements to hot water tanks, particularly glass-lined hot water tanks, have not thus far been adequate in the trades.

SUMMARY OF INVENTION

It is therefore a feature of the present invention to provide an adaptor assembly for securing a resistive electric heating element to a hot water heating tank and which substantially overcomes all of the above-mentioned disadvantages of the prior art.

Another feature of the present invention is to provide an adaptor assembly for securing a resistive electric heating element to a hot water and wherein the adaptor consists of two parts, and namely, a hub and a removable connecting flange which is not welded to the hub and can be easily assembled and replaced and further facilitates the assembly of the resistive heating element to the tank after the tank has been subjected to heat treatment without the connecting flange.

According to the above features, from a broad aspect, the present invention provides an adaptor assembly for securing a resistive electric heating element to a hot water heating tank. The adaptor assembly comprises a hollow hub sealingly securable with a hole in a hot water tank outer wall with a connecting portion of the hub extending outwardly of the outer wall. Retention means is provided in the connecting portion of the hub to receive and removably retain an adaptor plate. The adaptor plate has connection means to receive connectors associated with a resistive heating element bracket to secure same to the plate with a resistive element extending in the tank through the hub. A sealing means is retained between the bracket and the hub.

BRIEF DESCRIPTION OF DRAWINGS

A preferred embodiment of the present invention will now be described with reference to the accompanying drawings, in which.

DESCRIPTION OF PREFERRED EMBODIMENTS

Figure 1A:
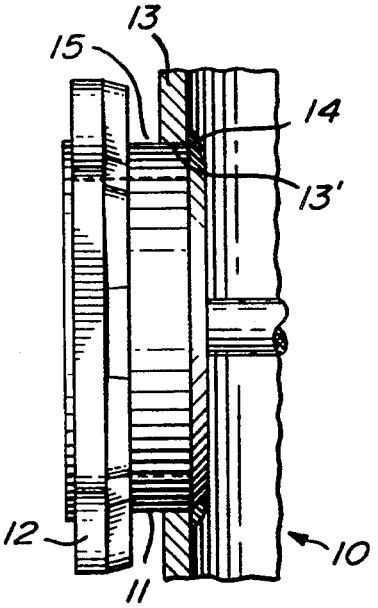
FIG. 1A (PRIOR ART)
FIG. 1A is a side view, partly sectioned, of a casted adaptor of the prior art.
Figure 1B:
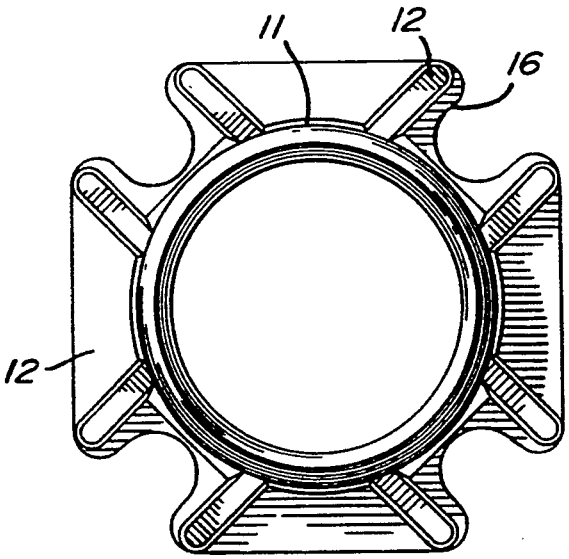
FIG. 1B (PRIOR ART)
FIGURE 1B is an end view of the adaptor of FIG. 1.
Figure 1C:
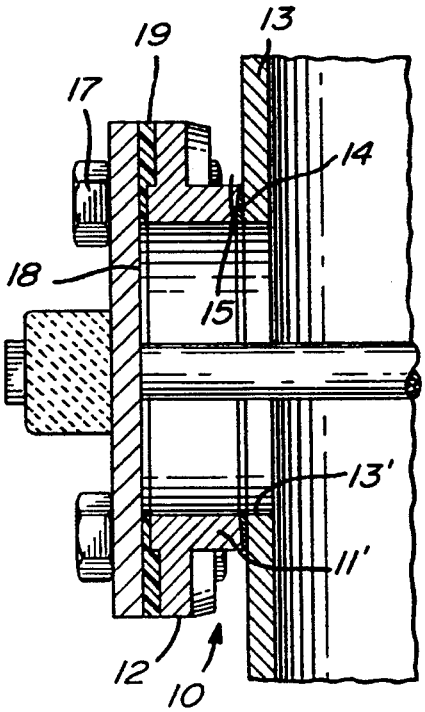
FIG. 1C (PRIOR ART)
FIG. 1C is a cross-section side view showing the adaptor secured to a tank wall and to a resistive electric heating element bracket assembly.

Referring now to the drawings, and more particularly to the prior art adaptor as illustrated by FIGS. 1A, 1B and 1C, there is shown an adaptor casting generally at 10 which consists of a hub portion 11 and a flange portion 12 formed integral with one another. The hub 11 is stick welded into a hole 13' formed in the side wall 13 of a hot water tank or otherwise welded by the inside at location 14. FIG. 1C shows a hub 11' which is projection fused welded at 15 about the hole 13' of the tank side wall 13. The flange has a slot 16 therein to receive the fastener bolts 17 when the resistive heating element assembly plate 18 is connected to the flanges 12. A seal 19 is usually disposed between the plate 18 and the hub 11 to provide a water seal. As can be seen, these flanges 12 are very thin members and often will break when excessive tightening force is applied by the fastener 17. This is particularly so if there is a weakness in the flange 12 caused by cavitation due to air bubbles trapped in the metal during the casting process. Also, as previously described, the entire adaptor is subjected to high temperature during the glass lining fusing and annealing phase of the manufacturing. This process considerably weakens the steel flanges due to loss of carbon in the steel. Because the adaptor forms an integral part of the tank, once a flange is broken, the coupling with the resistive heating element will develop leaks and often the entire tank is discarded or returned to the manufacturer. This is a costly procedure.

Figure 4A:
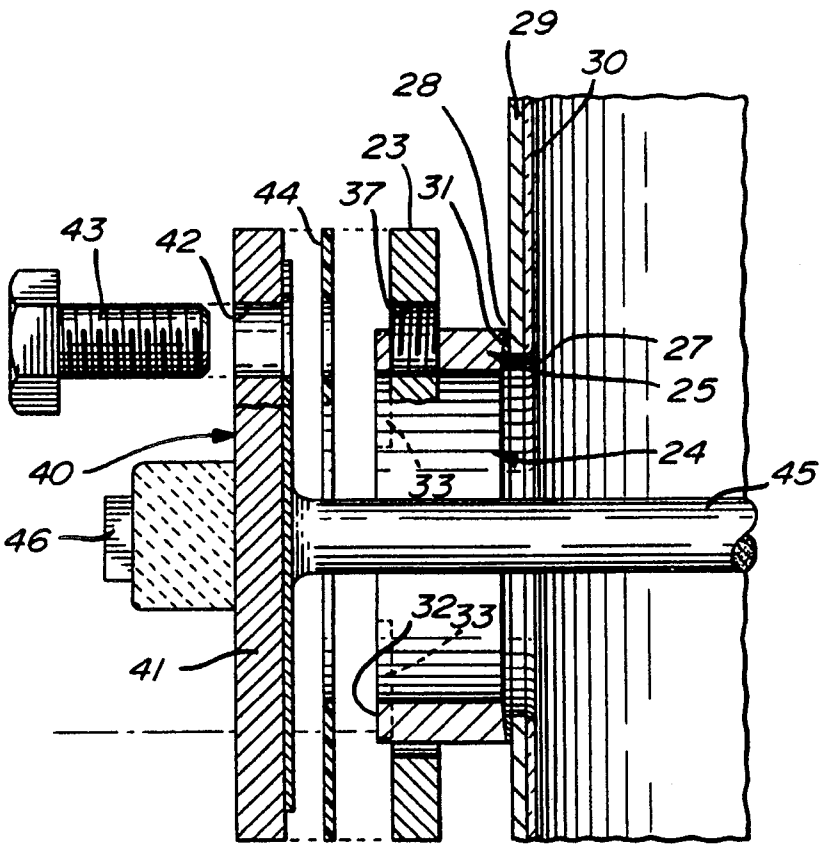
FIG. 4A is an exploded sectional view showing the adaptor assembly of FIG. 2A about a hole in a side wall of a hot water tank.
Figure 2B:
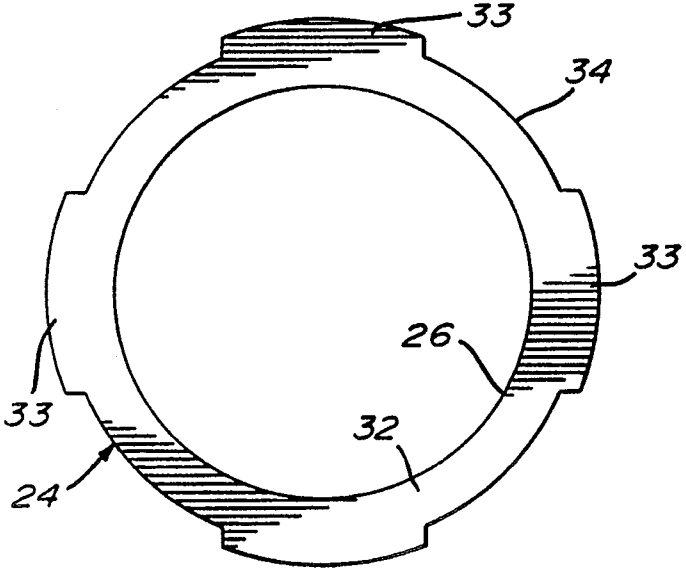
FIG. 2B is a top view of FIG. 2A.
Figure 2A:
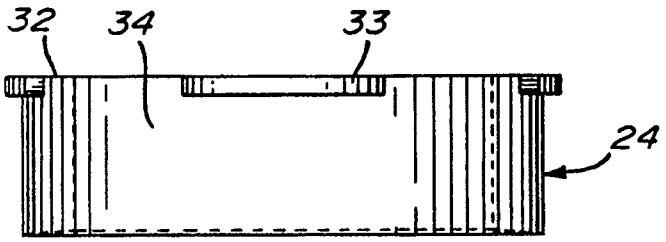
FIG. 2A is a side view of the hub of the adaptor assembly of the present invention for a projection weld securement to a hot water tank.
Figure 2C:
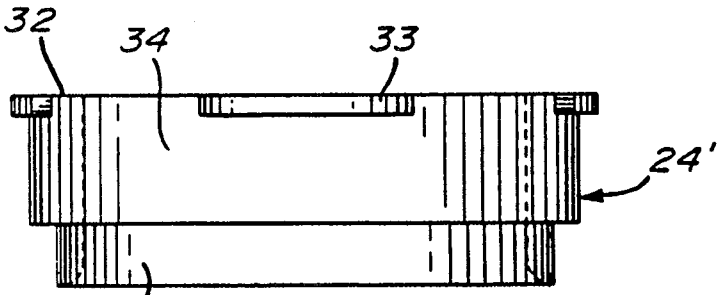
FIG. 2C is a side view of the hub of the adaptor assembly for an arc welding attachment to a hot water tank.
Figure 3B:
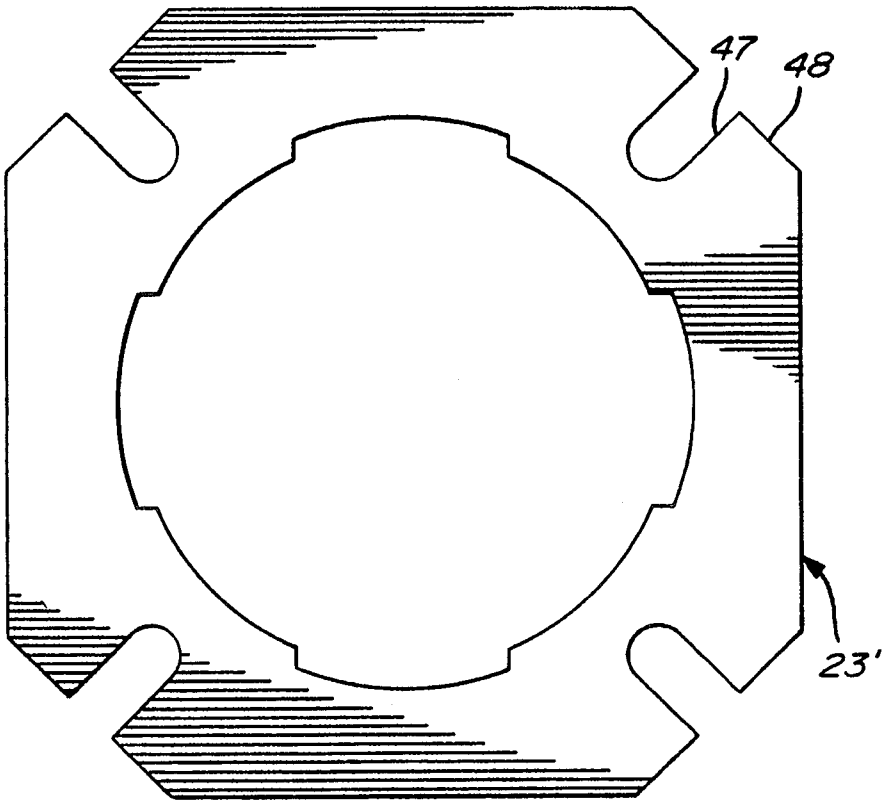
FIG. 3B is a view similar to FIG. 3A but showing a different plate configuration and plate connection.
Figure 3A:
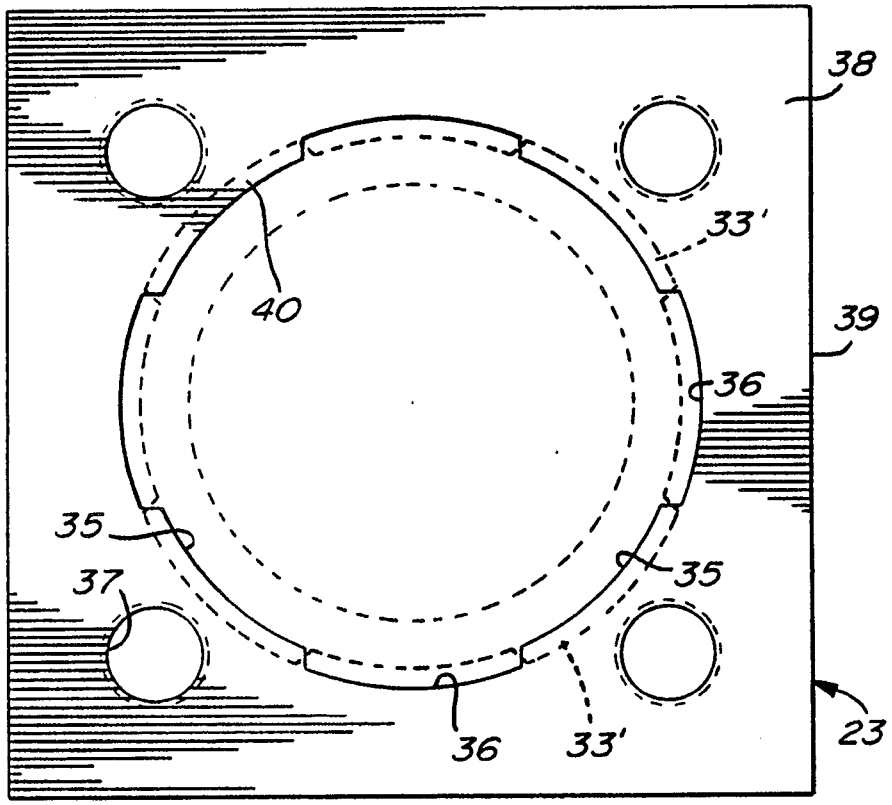
FIG. 3A is a plan view of the adaptor plate of the adaptor assembly of the present invention.

Referring now to FIGS. 2A to 2C and 4A and 4B, there will be described the adaptor assembly of the present invention. The adaptor assembly 25 of the present invention (see FIGS. 4A and 4B) comprises a hub as shown at 24 in FIGS. 2A and 2C, and an adaptor plate 23 and 23' as shown in FIGS. 3A and 3B respectively. The hub 24 is a hollow metal hub having a circular bore 26. The hub 24 is secured in or about a circular hole 27 formed in the outer wall 28 of a glass-lined hot water tank 29. As shown in FIG. 4A, the hub 24 of FIG 2A is projection welded or fused about the hole 27 of the water tank 29. The fusing of the lining 30 is effectuated after this welding process. The hub 24' as shown in FIG. 2C is arc welded about the hole 27 with the projection flange 24'' being situated inside the hole 27. Because the hub 24' is circular, the hole 27 in the tank can be machined to remove burrs whereby to obtain a tight fit therein and to obtain a substantially perfect seal when the glass lining 30 is fused thereto. The arc weld 31 is made about the hub 24 from the exterior thereof and this is done without the adaptor plate 23 positioned on the hub. This weld 31 is effectuated before the hot water tank 29 is subjected to the glass lining heat treatment process where the tank is heated up to temperatures of about 1600° F. During this heat treating process, the flange 23 is not present on the hub and accordingly it is not subjected to heat treatment which would otherwise weaken the steel.

As better shown in FIGS. 2A and 2B, the hub 24 and 24' has a flat annular outer face 32 and at least two opposed connecting flanges 33 project outwardly of the annular face 32. As herein shown, there are four diametrically opposed connecting flanges 33 and these constitute a connection or retention means for the adaptor plate. These flanges extend outwardly of the side wall 34 of the hub, as better illustrated in FIG. 2A and 2C.

Referring now to FIG. 3A, there is shown the construction of the adaptor plate 23. As herein shown, the adaptor plate 23 is a flat plate of rectangular contour and stamped or otherwise cut from a steel sheet. The adaptor plate is provided with a circular hole 35 for close fit about the outer side wall 34 f the hubo. Opposed recesses 36, herein four recesses, are diametrically aligned about the circular hole 35 whereby to receive and provide passage therein of the connecting flanges 33 of the hub 24. The square adaptor plate 23 is also provided with connection means in the form of threaded bores 37. These threaded bores are located in the corner portions 38 of the square plate in the area where there is more metal so as to strengthen the area about the bores 37. As shown, the recesses 36 are aligned with the opposed side edges 39 of the plate so as not to weaken the area in the vicinity of the threaded bores 37.

Referring again to FIGS. 4A and 4B, it can be seen that the plate 23 is removably connected to the hub by positioning it over the hub annular front wall 32 with the recesses 36 aligned with the retention flanges 33 so that the hub can be positioned rearwardly of the flanges 33. The plate is then turned about the hub side wall 34 so as to position the plate portions 40 behind the flanges 33 of the hub as shown by phantom line 33' in FIG. 3A. The resistive heating element bracket 40 is now ready to be secured to the adaptor assembly.

Figure 4B:
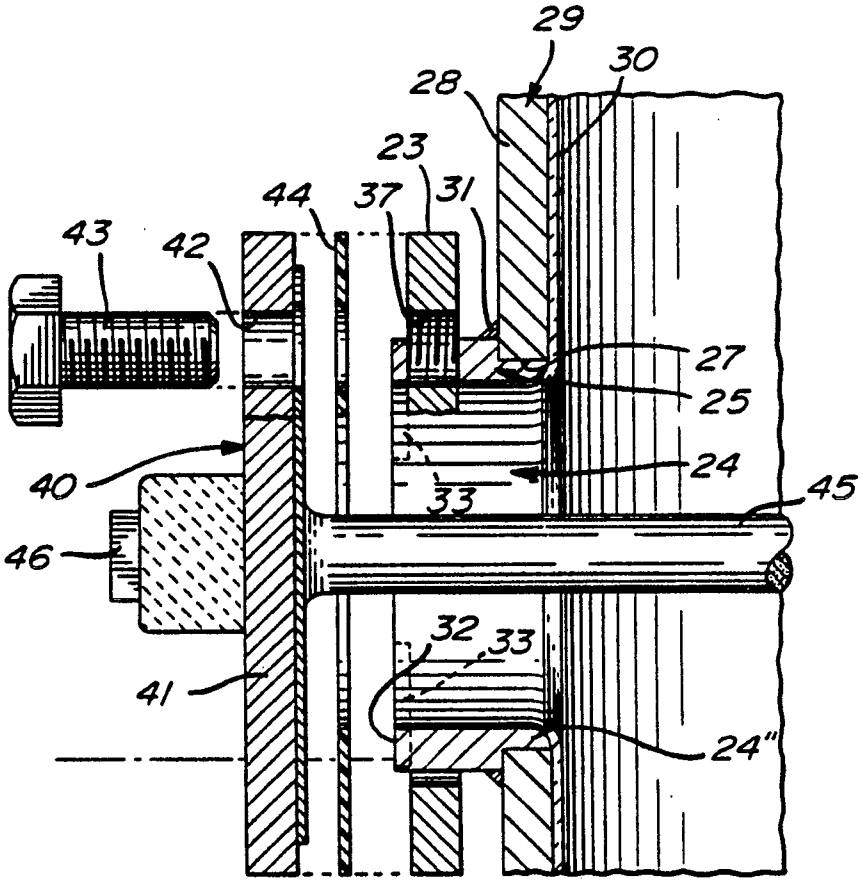
FIG. 4B is a view similar to FIG. 4 but showing the adaptor assembly of FIG. 2C arc welded to a hot water tank.

As shown in FIGS. 4A and 4B, the resistive heating element bracket consists of a back plate 41 which is usually a square plate and provided with through holes 42 in the corners thereof which are aligned with the threaded bores 37 of the adaptor plate 23 so that fastener bolts 43 extending through the holes 42 may be threaded in the bores 37 to clamp the back plate 41 onto the annular front wall 32 of the hub 24 with the adaptor plate clamped by pressure on the back face of the flange 33. A gasket 44 is disposed between the back plate and the annular hub front wall 32 and constitutes a sealing means. This gasket 44 is herein formed as a silicon impregnated asbestos gasket. A resistive heating element 45 protrudes from the back plate 41 and is provided with electrical connectors 46 to connect to a power supply. When the back plate is connected to the hub, the resistive elements 45 project within the tank to heat the water contained therein.

It can be seen that with the adaptor assembly of the present invention, the adaptor plate 23 is not welded to the hub but retained thereto by the clamping pressure of the bolt fasteners 43. Accordingly, if for any reason the adaptor plate 23 is defective or breaks, it can easily be removed and replaced. Also, the plate protects the hub from any mechanical connection with the resistive heating element bracket 40 thereby not subjecting the hub to wear. The adaptor plate also coacts with the hub under tension and not in shear and this is desirable seeing that the hub has been subjected to a heat and annealing treatment. To replace the adaptor plate or the electrical heating element, it is only necessary to remove the fastening bolts 43 and to change any part of the resistive heating element bracket or the adaptor plate.

It is within the ambit of the present invention to cover any obvious modifications of the preferred embodiment described herein provided such modifications fall within the scope of the appended claims. For example, as shown in FIG. 3B, the adaptor plate 23' is herein shown modified wherein the connecting means is provided by slots 47 disposed in a respective corner of the plate 23'. The corners of the plate have a diagonal cutout portion to form a straight ledge 48 and into which the open end of the slot 47 projects. Various other connector plate configurations can be designed. Another advantage of the adaptor assembly of the present invention is that it facilitates the assembly of the resistive heating elements to the tank. For example, the resistive heating element bracket can be assembled loosely with the adaptor plate 23 with the gasket 44 interposed therebetween. The entire assembly is then connected to the connecting flanges 23 by aligning the recesses 36 with the flanges and rotating the entire heating element bracket assembly so as to engage with the flanges 33 of the hub. The bolts 43 are then tightened and the entire assembly is connected to the hub 24 and hence the hot water tank. The hub 24 can also be machined from steel or cold headed for projection welding or arc welding as previously described, from the outside so as to provide a leakproof connection. Also, as previously described, because the hub has a round configuration, it is easy to machine the sharp edges at the weld on the tank and still get a good corrosion coating backup. Because this part is round, it can easily be located in the hole formed in the tank during the manufacturing process of the tank. During this process the hub is subjected to temperatures of up to 1600° F., where the steel loses about 30% of its force. Because the adaptor plate 23 is not connected during this process, it is not subjected to this weakening. Thus, the connector plate has good strong mechanical properties and the bolts can be tightened very hard to provide a tight connection and resulting in a better seal of the electric element with the hub.

The threaded bolt fasteners 43 may also be self-tapping bolts. The connecting threaded bores or slots may also be fewer in numbers or located differently depending on the location of the connecting holes in the resistive heating element back plate.

I claim:

1. An adaptor assembly for securing a resistive electric heating element to a hot water heating tank, said adaptor assembly comprising a cylindrical hollow hub having an outer connecting face sealingly securable about a hole in a hot water tank outer wall with a connecting portion of said hub extending outwardly of said outer wall and spaced from an outer wall of said tank, said connecting portion having at least two opposed connecting flanges extending outwardly of an outer side wall of said hub adjacent said outer connecting face, said connecting flanges being formed integral with said hub and extending from said outer side wall of said hub. said retention members being releasably engaged by an adaptor plate, said adaptor plate having a circular hole therein for close fit with said hub outer side wall, and opposed recesses in an inner side edge of said circular hole to receive said connecting flanges in alignment therethrough so that said adaptor plate can be slid over said connecting flanges and connected to said hub by rotational displacement of said adaptor plate about said hub outer side wall rearwardly of said connecting flanges to align said flange in interference fit with said adaptor plate, said adaptor plate having connection means to receive connectors associated with a resistive heating element bracket to secure same to said plate with a resistive element extending in said tank through said hub, and sealing means retainable between said bracket and said hub.

2. An adaptor assembly as claimed in claim 1 wherein said adaptor plate connection means are threaded bores spaced apart about said plate to receive bolt connectors therein.

3. An adaptor assembly as claimed in claim 1 wherein said adaptor plate is a square plate, said connecting means are slots disposed in a respective corner of said plate, said slots each having an open outer end, said corners of said plate having a diagonal cut-out portion.

4. An adaptor assembly as claimed in claim 2 wherein said plate is a square steel plate with one of said threaded bores being disposed in a respective corner of said plate, said opposed recesses being offset and disposed between a pair of said threaded bores whereby said plate has maximum strength in said corners where said threaded bores are formed.

5. An adaptor assembly as claimed in claim 3 or 4 wherein there are four of said connecting flanges about said hub and extending at right angles to one another, there being four of said recesses about said circular hole and also disposed at right angles to one another and centrally aligned with a respective outer side edge of said square plate.

6. An adaptor assembly as claimed in claim 1 wherein said hub is welded about its said outer side wall with said tank outer wall, said hub having a flange extending into said hole in said tank and wherein said tank is subjected to a heating and annealing glass lining process so that said glass lining extends to said flange across said hole, said adaptor plate being freed of said hub during said process.

7. An adaptor assembly as claimed in claim 1 wherein said sealing means is a silicon impregnated asbestos gasket.

* * * * *